US012193583B1

(12) United States Patent
Ou

(10) Patent No.: US 12,193,583 B1
(45) Date of Patent: Jan. 14, 2025

(54) SEALING LID FOR STRAW, AND CUP AND STRAW WITH SEALING LID

(71) Applicant: Zhenzhao Ou, Shenzhen (CN)

(72) Inventor: Zhenzhao Ou, Shenzhen (CN)

( * ) Notice: Subject to any disclaimer, the term of this patent is extended or adjusted under 35 U.S.C. 154(b) by 0 days.

(21) Appl. No.: 18/656,963

(22) Filed: May 7, 2024

(30) Foreign Application Priority Data

Apr. 18, 2024 (CN) ..... 202420813983.X

(51) Int. Cl.

| | |
|---|---|
| ***A47G 21/18*** | (2006.01) |
| ***A47G 19/22*** | (2006.01) |
| ***B65D 41/04*** | (2006.01) |
| ***B65D 53/02*** | (2006.01) |
| ***B65D 55/16*** | (2006.01) |
| *B65D 43/02* | (2006.01) |

(52) U.S. Cl.
CPC ..... *A47G 21/18* (2013.01); *A47G 19/2222* (2013.01); *B65D 53/02* (2013.01); *B65D 55/16* (2013.01); *B65D 41/0442* (2013.01); *B65D 43/0231* (2013.01); *B65D 2313/04* (2013.01)

(58) Field of Classification Search
CPC ..... A47G 21/18; A47G 19/2222; A47G 19/2272; B65D 43/0231; B65D 53/02; B65D 2543/00092; B65D 2543/00231; B65D 2543/00972; B65D 2313/04; B65D 41/0492; B65D 51/24; B65D 41/0442; B65D 2543/00046; B65D 1/023; B65D 2251/0012; B65D 41/0414; B65D 41/0421; B65D 41/0428; A61J 9/006; A24F 40/10
USPC ..... 215/388, 11.6, 12.1; 220/717
See application file for complete search history.

(56) References Cited

U.S. PATENT DOCUMENTS

| | | | | |
|---|---|---|---|---|
| 10,232,993 | B2 * | 3/2019 | Seiders | A47G 19/2272 |
| 2012/0199548 | A1 * | 8/2012 | Kitto | B65D 55/16 215/316 |
| 2014/0138344 | A1 * | 5/2014 | Bengtsson | C02F 1/482 215/386 |
| 2016/0365184 | A1 * | 12/2016 | Schein | H01F 7/02 |
| 2019/0117000 | A1 * | 4/2019 | Lockhart | A47G 19/2272 |
| 2019/0191904 | A9 * | 6/2019 | Tebbe | B65D 23/104 |
| 2019/0357711 | A1 * | 11/2019 | Nichols | B65D 53/02 |

* cited by examiner

*Primary Examiner* — Nathan J Jenness
*Assistant Examiner* — John Martin Hoppmann

(57) ABSTRACT

A sealing lid for a straw, and a cup and a straw with a sealing lid include: a lid main body for sealing a straw opening, and an attracting element connected to the lid main body. The attracting element is configured for magnetically attracting with a cup main body or a straw main body. Therefore, users can attach the lid main body to a side wall of the cup main body or a side wall of the straw main body. When users need to seal a cup opening or the straw opening, the lid main body can be used to seal the cup opening or the straw opening to prevent liquid leakage. When users need to open the cup opening or the straw opening, the lid main body can be detached from the cup opening or the straw opening.

20 Claims, 12 Drawing Sheets

SEALING LID FOR STRAW, AND CUP AND STRAW WITH SEALING LID

CROSS-REFERENCE TO RELATED APPLICATIONS

The application claims priority of Chinese patent application CN202420813983X, filed on Apr. 18, 2024, which is incorporated herein by reference in its entireties.

TECHNICAL FIELD

The present invention relates to a field of sealing lids, in particular to a sealing lid for a straw, and a cup and a straw with a sealing lid.

BACKGROUND ART

A sealing lid of a cup or a straw on the market is usually fixed on the cup or the straw with a traditional fixing ring, making it not convenient to install and use. Due to the different sizes and specifications of the cups and the straws on the market, if an inner diameter of the fixing ring of the sealing lid is smaller than an outer diameter of the cup or the straw, the sealing lid cannot be installed on the cup or the straw. If the inner diameter of the fixing ring is larger than the cup or the straw, the lid will be loose and easy to fall off when installed.

SUMMARY

In order to overcome the shortcomings of the prior art, a sealing lid for a straw is provided by the present invention, including: a lid main body, the lid main body being configured for sealing a straw opening; and an attracting element, the attracting element being connected to the lid main body, and the attracting element being configured for magnetically attracting with a cup main body or a straw main body.

As an improvement of the present invention, the lid main body is equipped with a first accommodating cavity and a first accommodating opening. The first accommodating cavity is surrounded and formed by a side wall of the lid main body. The first accommodating opening is in communication with the first accommodating cavity. The attracting element is inserted into the first accommodating cavity through the first accommodating opening.

As an improvement of the present invention, the lid main body includes a first stop part with elasticity, and the first accommodating opening is defined in the first stop part. An inner diameter of the first accommodating opening is expandable and contractible. When the attracting element is placed into the first accommodating cavity through the first accommodating opening, the first stop part keeps the attracting element in the first accommodating cavity.

As an improvement of the present invention, an initial inner diameter of the first accommodating opening is smaller than an outer diameter of the attracting element, and the inner diameter of the first accommodating opening can be expanded to be greater than or equal to the outer diameter of the attracting element, so that the attracting element is capable of being inserted into the first accommodating cavity through the first accommodating opening. When the attracting element is inserted into the first accommodating cavity through the first accommodating opening, the inner diameter of the first accommodating opening is capable of restoring and contracting to the initial inner diameter, so that the first stop part keeps the attracting element in the first accommodating cavity.

As an improvement of the present invention, the lid main body is equipped with a protruding part, and the protruding part extends from a top wall of the lid main body to a bottom wall of the lid main body. The first accommodating cavity is defined in the protruding part, and the first accommodating cavity extends from an upper side of the protruding part to a lower side of the protruding part. The first accommodating opening is defined in a bottom of the protruding part.

As an improvement of the present invention, the attracting element is a magnetic attraction element.

As an improvement of the present invention, the lid main body is flexible. The lid main body includes the top wall, a first elastic side wall, and an elastic plunger. The first elastic side wall and the elastic plunger extend from the top wall. A sealing slot is surrounded and formed between the first elastic side wall and the elastic plunger. The sealing slot is equipped with a slot opening. The sealing slot is configured for squeezing and sealing the straw opening.

As an improvement of the present invention, the first elastic side wall is used for pressing against an outer side wall of the straw opening, the elastic plunger is used for inserting into the straw opening, and the elastic plunger is used for pressing against an inner side wall of the straw opening, so that the sealing slot is used for squeezing and sealing the straw opening.

As an improvement of the present invention, the first elastic side wall is in a straight cylindrical shape.

As an improvement of the present invention, the elastic plunger is in a conical shape with a wider top and a narrower bottom, and a diameter of the elastic plunger gradually increases from bottom to top.

As an improvement of the present invention, the first elastic side wall or the elastic plunger is provided with a plurality of raised elastic sealing parts, and the sealing parts are positioned in the sealing slot. The sealing parts are used for squeezing and sealing the straw opening.

As an improvement of the present invention, the plurality of sealing parts are uniformly arranged from a lower side of the first elastic side wall to an upper side of the first elastic side wall in sequence.

As an improvement of the present invention, a total number of the sealing parts is two to twenty.

As an improvement of the present invention, the sealing parts are sealing rings.

As an improvement of the present invention, the lid main body is made of silicone.

As an improvement of the present invention, the attracting element is arranged in the first elastic side wall, the elastic plunger or the top wall.

As an improvement of the present invention, the attracting element and the lid main body are integrally formed by injection molding, or the attracting element is connected to the lid main body by gluing.

A cup is further provided by the present invention, including: a cup main body, the cup main body being equipped with a cup opening; a lid main body, the lid main body being configured for sealing the cup opening; and an attracting element, the attracting element being connected to the lid main body, and the attracting element being configured for detachably attracting with a side wall of the cup main body.

As an improvement of the present invention, the lid main body includes a top wall, a first elastic side wall, and an elastic plunger. The first elastic side wall and the elastic plunger extend from the top wall. A sealing slot is surrounded and formed between the first elastic side wall and the elastic plunger. The sealing slot is equipped with a slot opening, and the sealing slot is configured for squeezing and sealing the cup opening. When a first upper end wall of the cup main body is placed in the sealing slot, the lid main body covers the cup opening, and an inner wall of the sealing slot squeezes and seals the first upper end wall of the cup main body, so that the sealing slot squeezes and seals the cup opening.

A straw is further provided by the present invention, including: a cup main body, the cup main body being equipped with a cup opening; a straw main body, the straw main body being equipped with a straw opening, and the straw main body being inserted into the cup main body through the cup opening; a lid main body, the lid main body being configured for sealing the straw opening; and an attracting element, the attracting element being connected to the lid main body, and the attracting element being configured for detachably attracting with a side wall of the cup main body.

As an improvement of the present invention, the lid main body includes a top wall, a first elastic side wall, and an elastic plunger. The first elastic side wall and the elastic plunger extend from the top wall. A sealing slot is surrounded and formed between the first elastic side wall and the elastic plunger. The sealing slot is equipped with a slot opening, and the sealing slot is configured for squeezing and sealing the straw opening. When a second upper end wall of the straw main body is placed in the sealing slot, the lid main body covers the straw opening, and an inner wall of the sealing slot squeezes and seals the second upper end wall of the straw main body, so that the sealing slot squeezes and seals the straw opening.

A straw is further provided by the present invention, including: a straw main body, the straw main body being provided with a straw opening; a lid main body, the lid main body being configured for sealing the straw opening; and an attracting element, the attracting element being connected to the lid main body, and the attracting element being configured for detachably attracting with a side wall of the straw main body.

The sealing lid for the straw, and the cup and the straw with the sealing lid are provided by the present invention, including the lid main body and the attracting element. The lid main body is used for sealing the straw opening. The attracting element is connected to the lid main body, and the attracting element is used for magnetically attracting with the cup main body or the straw main body. Therefore, users can attach the lid main body to the side wall of the cup main body or the side wall of the straw main body. When users need to seal the straw opening, the lid main body can be used to seal and cover the straw opening to prevent liquid leakage from the straw opening. When users need to open the straw opening, the lid main body can be detached from the straw opening, and the lid main body can be attracted and connected to the side wall of the cup main body or the side wall of the straw main body through the attracting element. Compared with a method of using a traditional fixing ring to fix the lid main body to the side wall of the cup main body or the side wall of the straw main body on the market, the present invention is more convenient for the installation and disassembly of the lid main body with high adaptability, and is not affected by a size of the cup main body or the straw main body.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
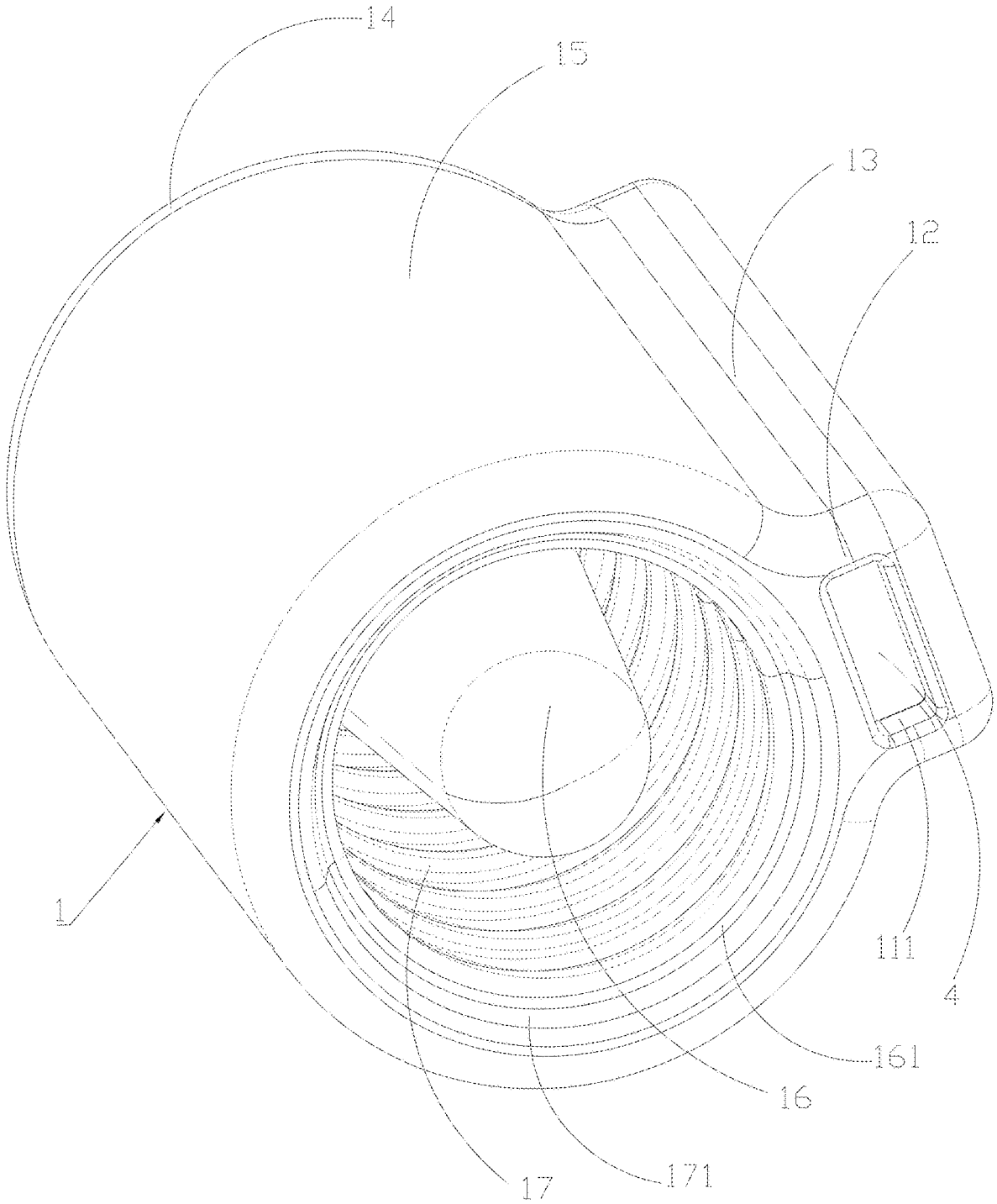
FIG. 1 is a schematic diagram of an overall structure of a sealing lid according to the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
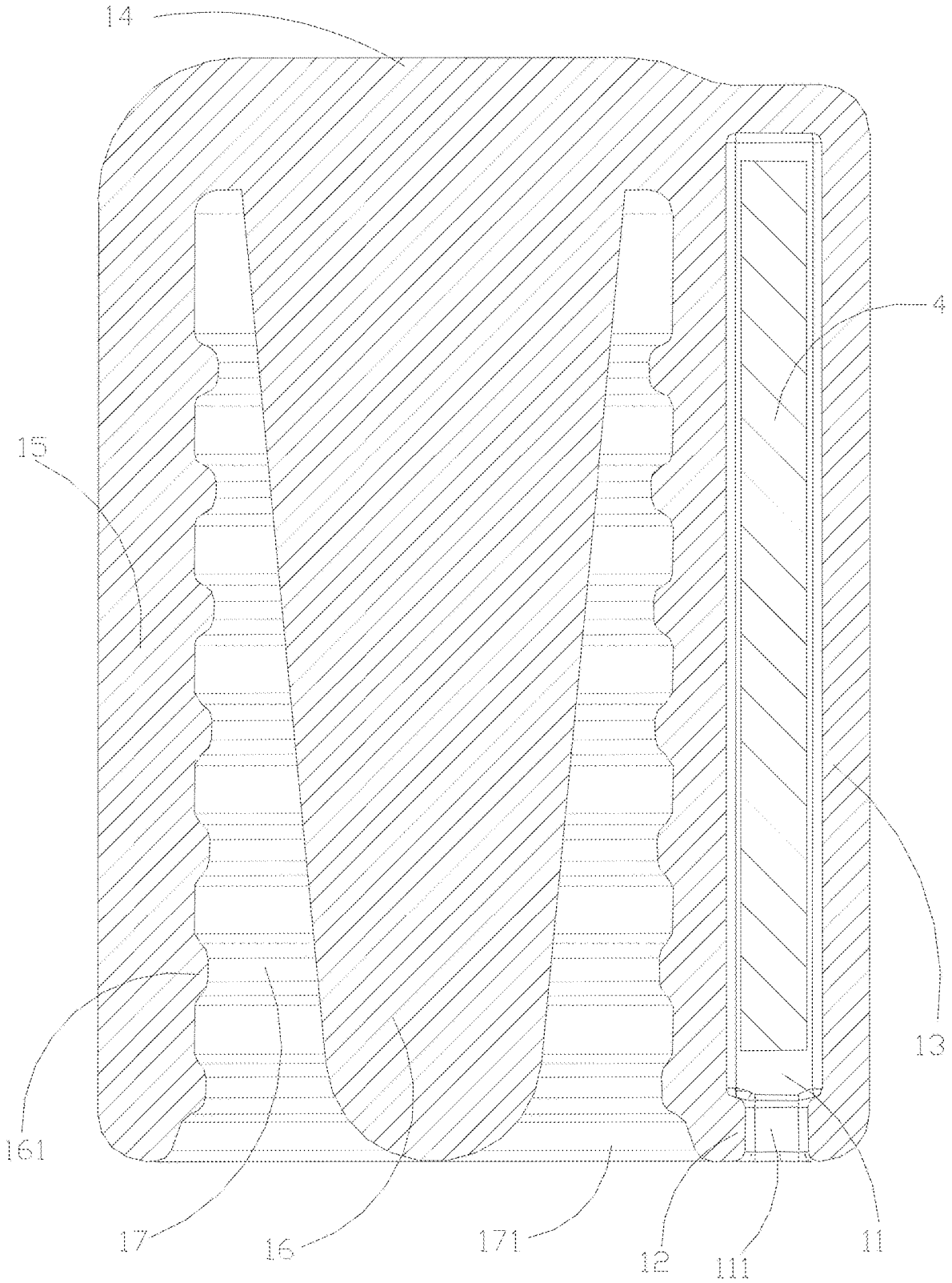
FIG. 2 is a sectional view of a sealing lid.

Referring to FIGS. 1-2, a sealing lid for a straw includes: a lid main body 1, the lid main body 1 being configured for sealing a straw opening 31; and an attracting element 4, the attracting element 4 being connected to the lid main body 1, and the attracting element 4 being configured for magnetically attracting with a cup main body 2 or a straw main body 3.

Through the above structure, the sealing lid includes the lid main body 1 and the attracting element 4. The lid main body 1 is used for sealing the straw opening 31. The attracting element 4 is connected to the lid main body 1, and the attracting element 4 is used for magnetically attracting with the cup main body 2 or the straw main body 3. Therefore, users can attach the lid main body 1 to a side wall of the cup main body 2 or a side wall of the straw main body 3. When users need to seal the straw opening 31, the lid main body 1 can be used to seal and cover the straw opening 31 to prevent liquid leakage from the straw opening 31. When users need to open the straw opening 31, the lid main body 1 can be detached from the straw opening 31, and the lid main body 1 can be attracted and connected to the side wall of the cup main body 2 or the side wall of the straw main body 3 through the attracting element 4. Compared with a method of using a traditional fixing ring to fix the lid main body 1 to the side wall of the cup main body 2 or the side wall of the straw main body 3 on the market, the present invention is more convenient for the installation and disassembly of the lid main body 1 with high adaptability, and is not affected by a size of the cup main body 2 or the straw main body 3.

The attracting element 4 can be a magnetic attraction element, and can also be a sucker, etc.

In this embodiment, the lid main body 1 is equipped with a first accommodating cavity 11 and a first accommodating opening 111. The first accommodating cavity 11 is surrounded and formed by a side wall of the lid main body 1. The first accommodating opening 111 is in communication with the first accommodating cavity 11. The attracting element 4 is inserted into the first accommodating cavity 11 through the first accommodating opening 111. The lid main body 1 includes a first stop part 12 with elasticity, and the first accommodating opening 111 is defined in the first stop part 12. An inner diameter of the first accommodating opening 111 is expandable and contractible. When the attracting element 4 is placed into the first accommodating cavity 11 through the first accommodating opening 111, the first stop part 12 keeps the attracting element 4 in the first accommodating cavity 11. Specifically, an initial inner diameter of the first accommodating opening 111 is smaller than an outer diameter of the attracting element 4, and the inner diameter of the first accommodating opening 111 can be expanded to be greater than or equal to the outer diameter of the attracting element 4, so that the attracting element 4 is capable of being inserted into the first accommodating cavity 11 through the first accommodating opening 111. When the attracting element 4 is inserted into the first accommodating cavity 11 through the first accommodating opening 111, the inner diameter of the first accommodating opening 111 is capable of restoring and contracting to the initial inner diameter, so that the first stop part 12 keeps the attracting element 4 in the first accommodating cavity 11. Furthermore, the lid main body 1 is equipped with a protruding part 13, and the protruding part 13 extends from a top wall 14 of the lid main body 1 to a bottom wall of the lid main body 1. The first accommodating cavity 11 is defined in the protruding part 13, and the first accommodating cavity 11 extends from an upper side of the protruding part 13 to a lower side of the protruding part 13. The first accommodating opening 111 is defined in a bottom of the protruding part 13. Furthermore, the attracting element 4 is a magnetic attraction element. Through the above structure, the installation of the attracting element 4 is effectively achieved, and the attracting element 4 can be effectively prevented from loosening from the lid main body 1. Furthermore, since the attracting element 4 is the magnetic attraction element, the lid main body 1 can be magnetically attracted with a side wall of the stainless-steel cup main body 2 or a side wall of the stainless-steel straw main body 3 through the magnetic attraction element, making the installation and disassembly of the lid main body 1 more easier with high adaptability and not affected by the size of the cup main body 2 or straw main body 3. For example, when the lid main body 1 is used for sealing a cup opening 21, the lid main body 1 can be magnetically attracted with the side wall of the stainless-steel cup main body 2 through the magnetic attraction element, so that users can use the lid main body 1 to seal the cup opening 21 at any time. For another example, when the lid main body 1 is used to seal the straw opening 31, the lid main body 1 can be magnetically attracted with the side wall of the stainless-steel straw main body 3 through the magnetic attraction element, so that users can use the lid main body 1 to seal the straw opening 31 at any time. For another example, when the straw is inserted into the cup main body 2 and the lid main body 1 is used to seal the straw opening 31, the lid main body 1 can be magnetically attracted with the side wall of the stainless-steel cup main body 2 through the magnetic attraction element, so that users can use the lid body 1 to seal the straw opening 31 at any time. For another example, when the straw is inserted into the cup main body 2 and the lid main body 1 is used to seal the cup opening 21, the lid main body 1 can be magnetically attracted with the side wall of the stainless-steel straw main body 3 through the magnetic attraction element, so that users can use the lid main body 1 to seal the cup opening 21 at any time. Furthermore, since the inner diameter of the first accommodating opening 111 is expandable and contractible, it is convenient for users to install and fix the attracting element 4 in the first accommodating cavity 11.

In this embodiment, the lid main body 1 is flexible. The lid main body 1 includes the top wall 14, a first elastic side wall 15, and an elastic plunger 16. The first elastic side wall 15 and the elastic plunger 16 extend from the top wall 14. A sealing slot 17 is surrounded and formed between the first elastic side wall 15 and the elastic plunger 16. The sealing slot 17 is equipped with a slot opening 171. The sealing slot 17 is configured for squeezing and sealing the straw opening 31. The first elastic side wall 15 is used for pressing against an outer side wall of the straw opening 31, the elastic plunger 16 is used for inserting into the straw opening 31, and the elastic plunger 16 is used for pressing against an inner side wall of the straw opening 31, so that the sealing slot 17 is used for squeezing and sealing the straw opening 31. Specifically, the first elastic side wall 15 is in a straight cylindrical shape. Furthermore, the elastic plunger 16 is in a conical shape with a wider top and a narrower bottom, and a diameter of the elastic plunger 16 gradually increases from bottom to top. Furthermore, the first elastic side wall 15 or the elastic plunger 16 is provided with a plurality of raised elastic sealing parts 161, and the sealing parts 161 are positioned in the sealing slot 17. The sealing parts 161 are used for squeezing and sealing the straw opening 31. Furthermore, the plurality of sealing parts 161 are uniformly arranged from a lower side of the first elastic side wall 15 to an upper side of the first elastic side wall 15 in sequence. Furthermore, a total number of the sealing parts 161 is two to twenty. Furthermore, the sealing parts 161 are sealing rings. Furthermore, the lid main body 1 is made of silicone. Through the above structure, when the lid main body 1 covers the straw opening 31, an end wall of the straw opening 31 is inserted into the sealing slot 17 through the slot opening 171. The elastic plunger 16 and the first elastic side wall 15 squeeze and compress the end wall of the straw opening 31, so that the sealing slot 17 squeezes and seals the straw opening 31. Furthermore, since the plurality of sealing rings are provided, the sealing rings further squeeze the end wall of the straw opening 31, so that the straw opening 31 is further squeezed and sealed, thereby preventing liquid leakage through the straw opening 31. Furthermore, the cone-shaped elastic plunger with the wider top and the narrower bottom is capable of adapting to different sizes of straw openings or cup openings. For example, when a size of the straw opening or the cup opening is small, a narrower lower end of the elastic plunger can be inserted into the straw opening or the cup opening and seal the straw opening or the cup opening. For another example, when the size of the straw opening or the cup opening is large, a wider upper end of the elastic plunger can be inserted into the straw opening or the cup opening and seal the straw opening or the cup opening.

Figure 12:
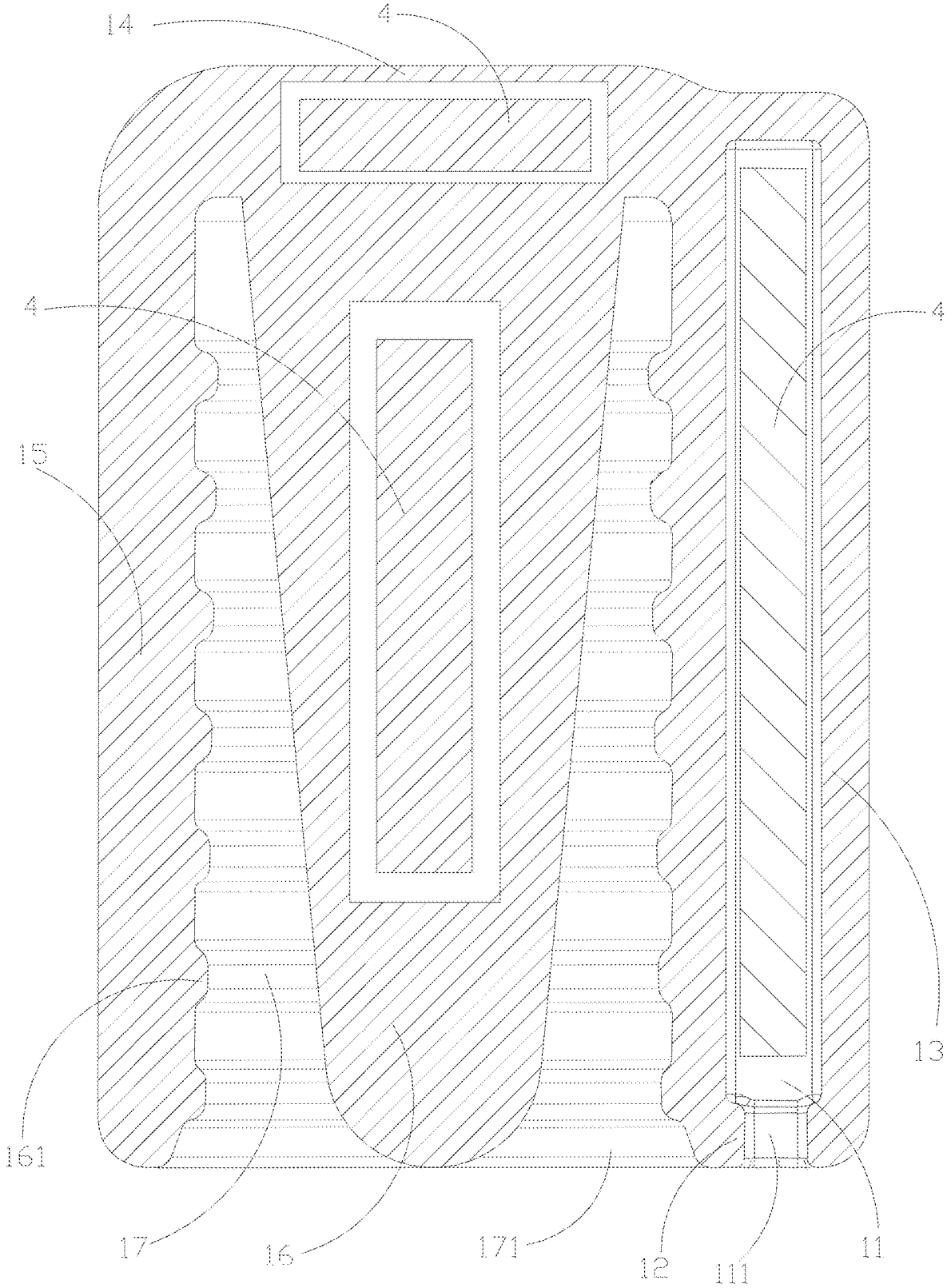
FIG. 12 is a sectional view of a lid main body when an attracting element is arranged in a first elastic side wall, an elastic plunger, or a top wall.

Referring to FIG. 12, the attracting element 4 is arranged in the first elastic side wall 15, the elastic plunger 16 or the top wall 14.

Furthermore, in some embodiments, the attracting element 4 and the lid main body 1 are integrally formed by injection molding. Alternatively, the attracting element 4 is connected to the lid main body 1 by gluing.

Figure 3:
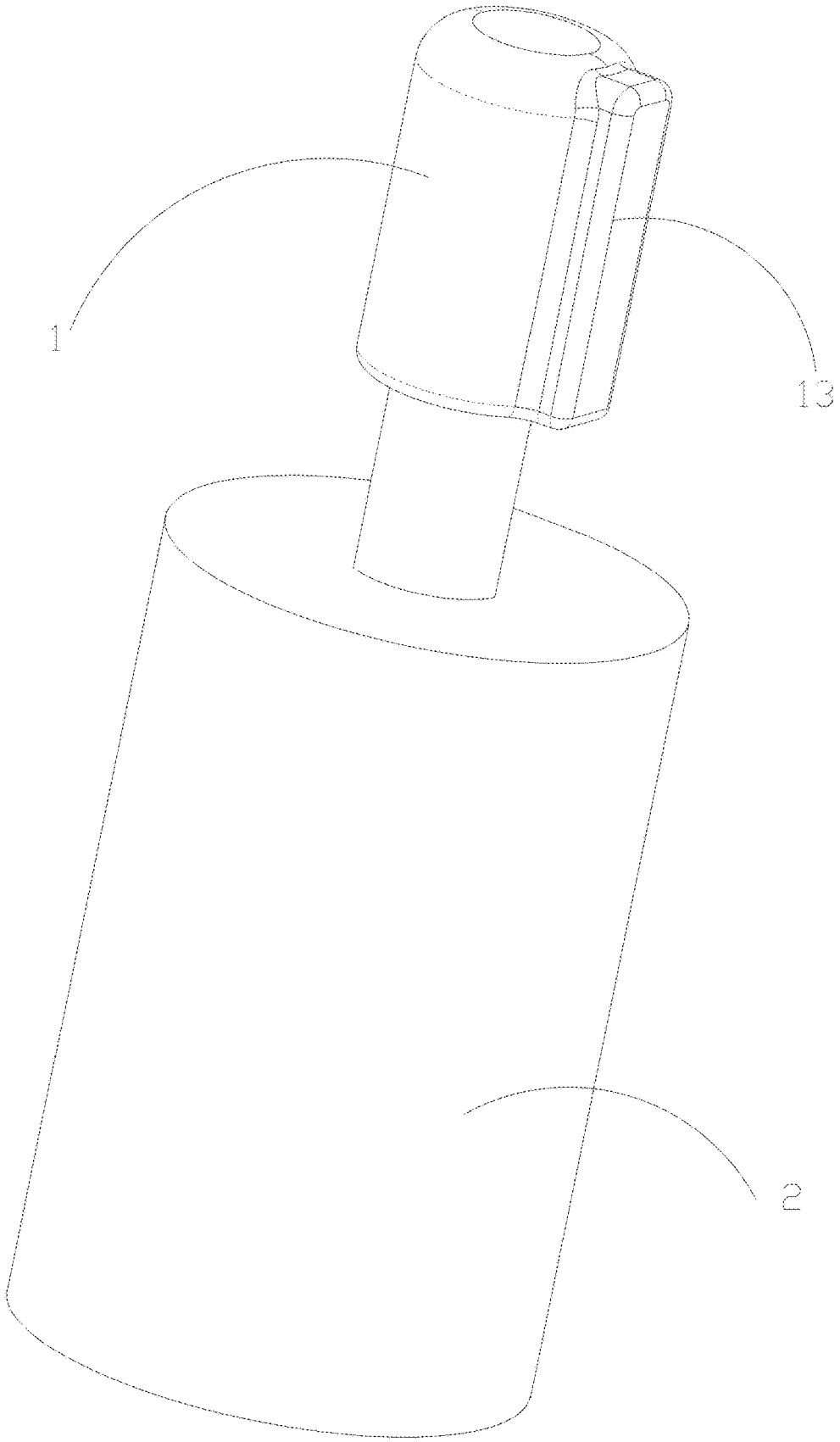
FIG. 3 is a schematic diagram of a structure when a sealing lid seals a cup opening.
Figure 4:
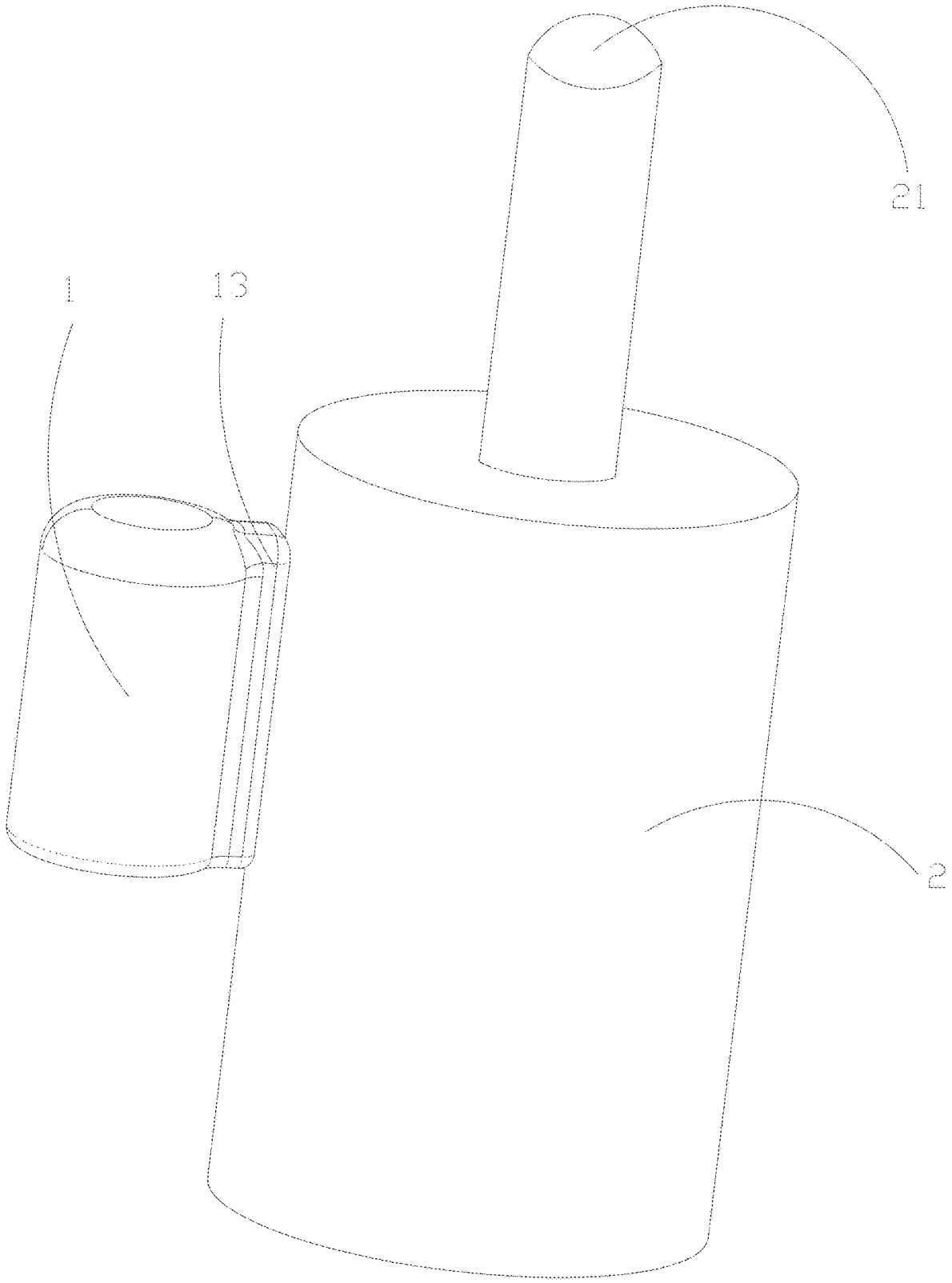
FIG. 4 is a schematic diagram of a structure when a sealing lid attracts with a side wall of a cup main body.
Figure 5:
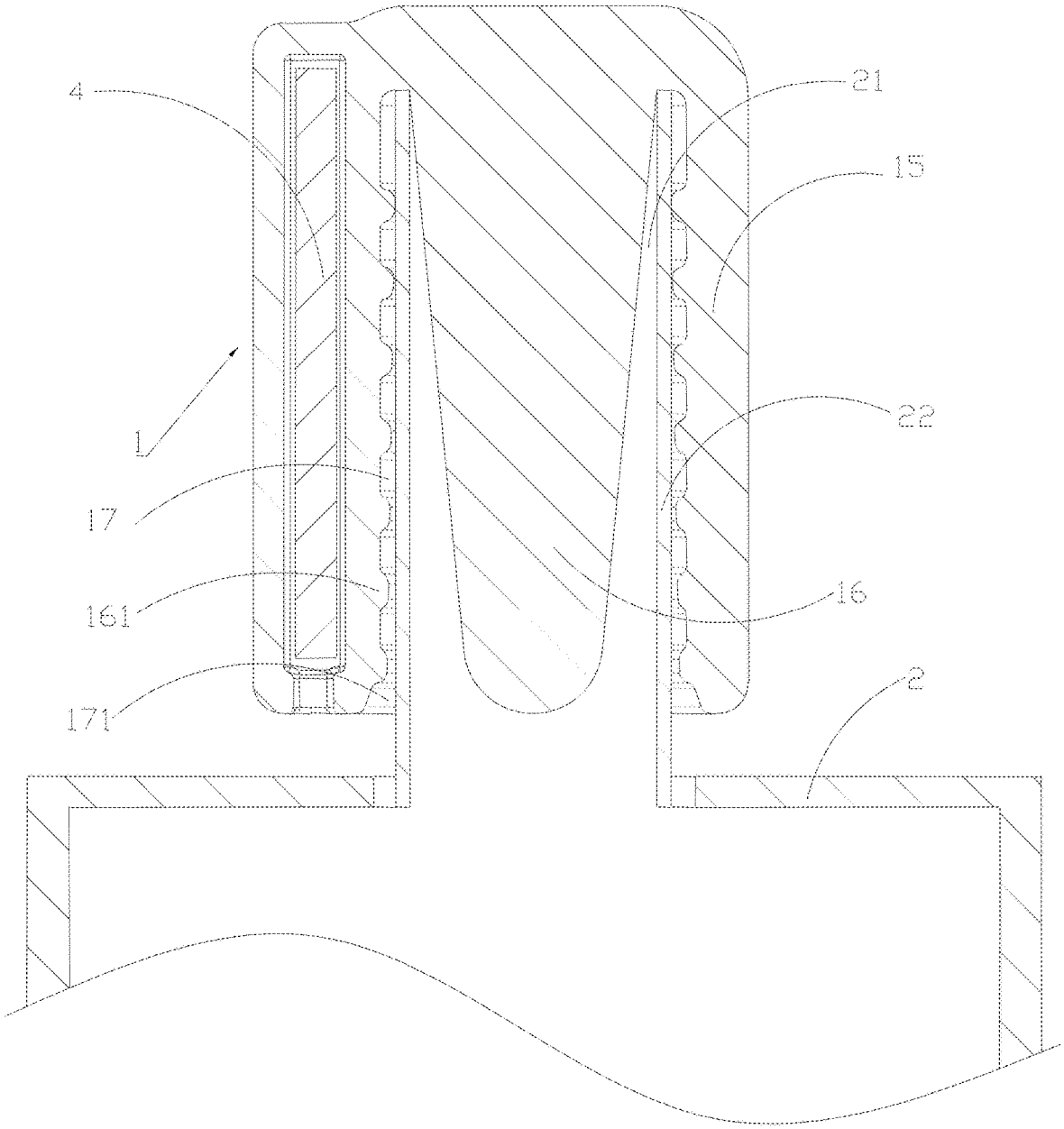
FIG. 5 is a sectional view of a cup main body and a sealing lid when the sealing lid seals a cup opening.

Referring to FIGS. 3-5, a cup includes: a cup main body 2, the cup main body 2 being equipped with a cup opening 21; a lid main body 1, the lid main body 1 being configured for sealing the cup opening 21; and an attracting element 4, the attracting element 4 being connected to the lid main body 1, and the attracting element 4 being configured for detachably attracting with a side wall of the cup main body 2.

Through the above structure, when the lid main body 1 is used to seal the cup opening 21, the lid main body 1 can be magnetically attracted with a side wall of the stainless-steel cup main body 2 through a magnetic attraction element, so that users can use the lid main body 1 to seal the cup opening 21 at any time.

The lid main body 1 includes a top wall 14, a first elastic side wall 15, and an elastic plunger 16. The first elastic side wall 15 and the elastic plunger 16 extend from the top wall 14. A sealing slot 17 is surrounded and formed between the first elastic side wall 15 and the elastic plunger 16. The sealing slot 17 is equipped with a slot opening 171, and the sealing slot 17 is configured for squeezing and sealing the cup opening 21. When a first upper end wall 22 of the cup main body 2 is placed in the sealing slot 17, the lid main body 1 covers the cup opening 21, and an inner wall of the sealing slot 17 squeezes and seals the first upper end wall 22 of the cup main body 2, so that the sealing slot 17 squeezes and seals the cup opening 21.

Figure 6:
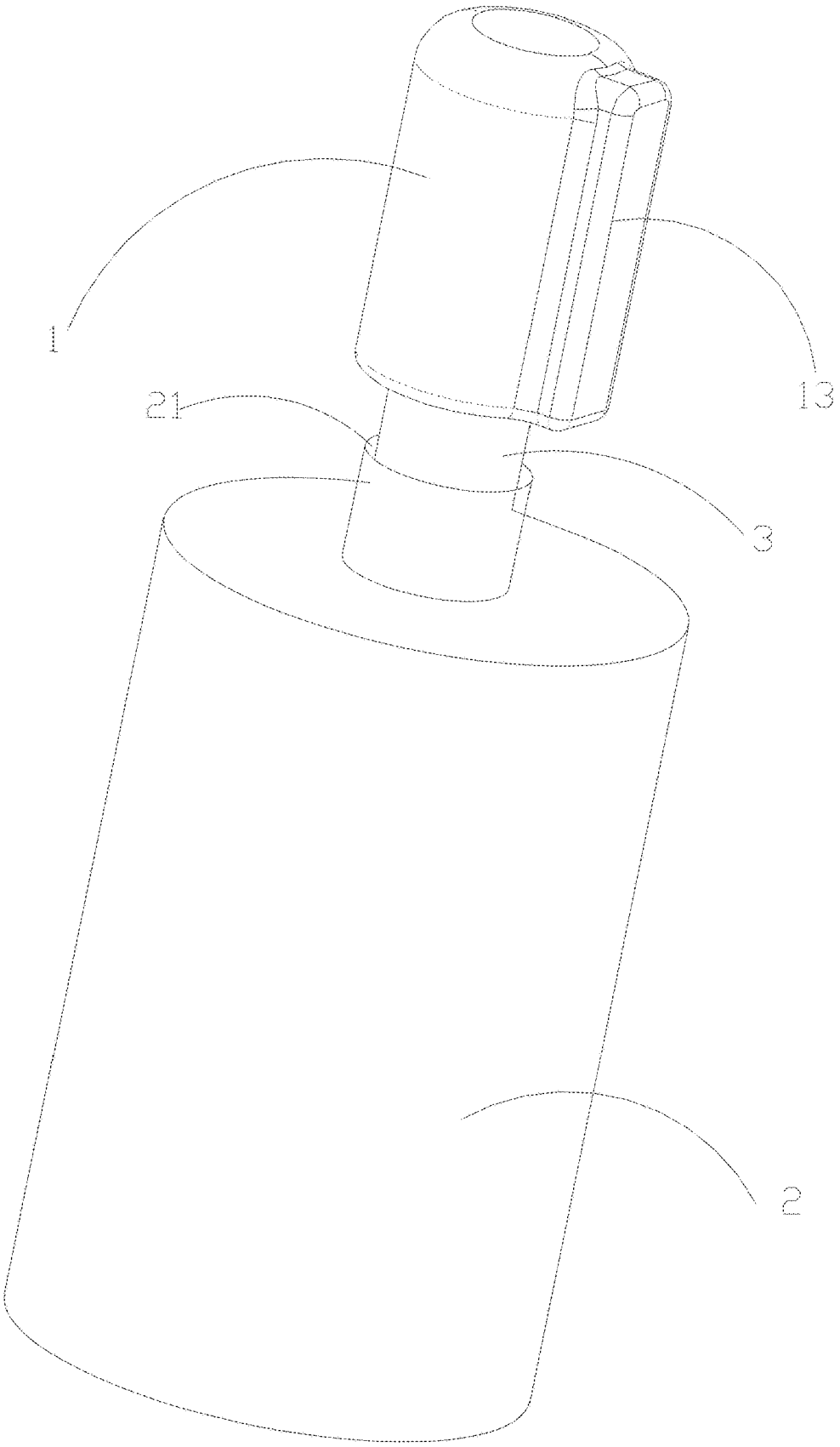
FIG. 6 is a schematic diagram of a structure when a straw main body is inserted into a cup main body through a cup opening, and a sealing lid seals a straw opening.
Figure 7:
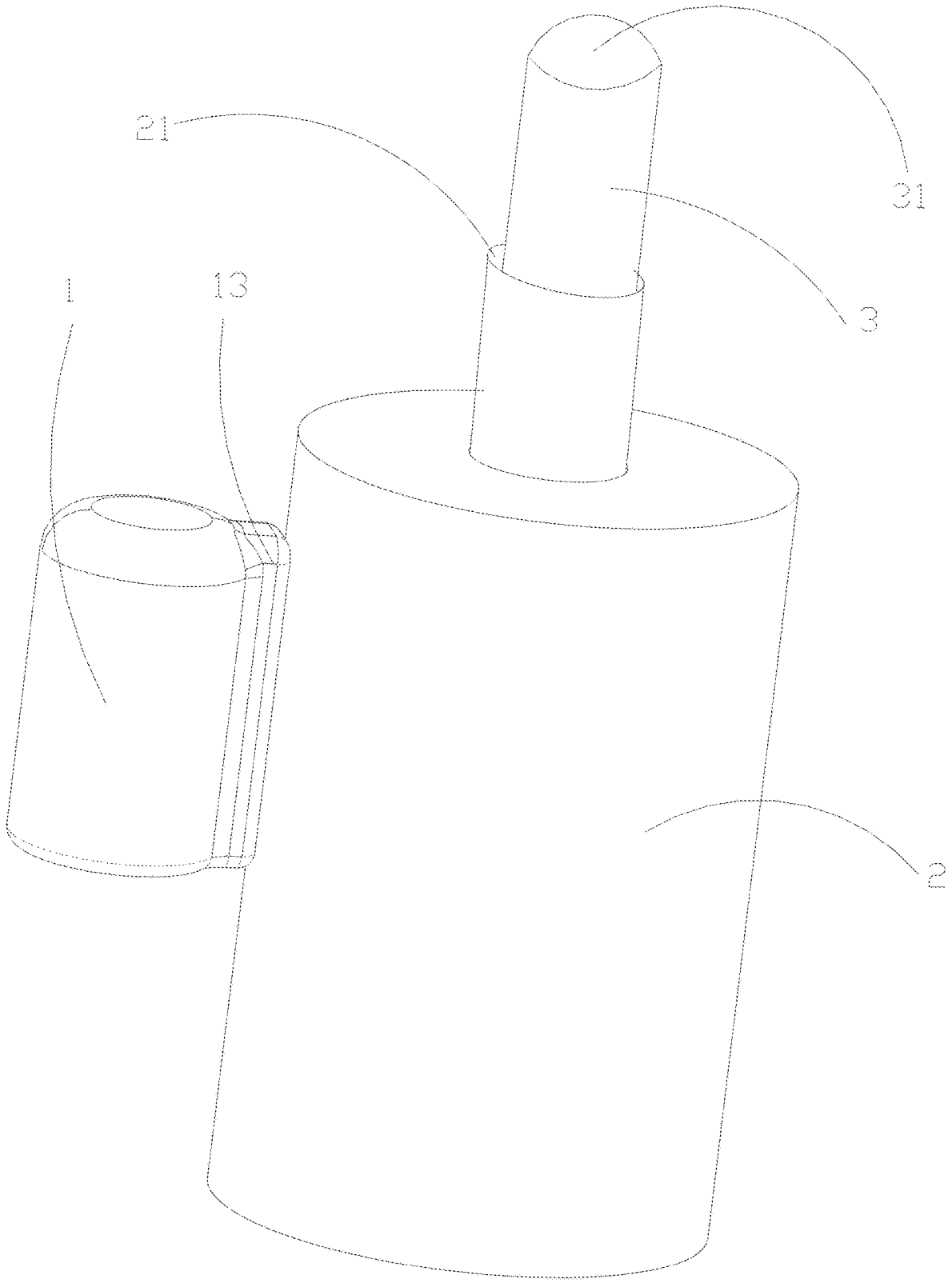
FIG. 7 is a schematic diagram of a structure when a straw main body is inserted into a cup main body through a cup opening, and a sealing lid attracts with a side wall of the cup main body.
Figure 8:
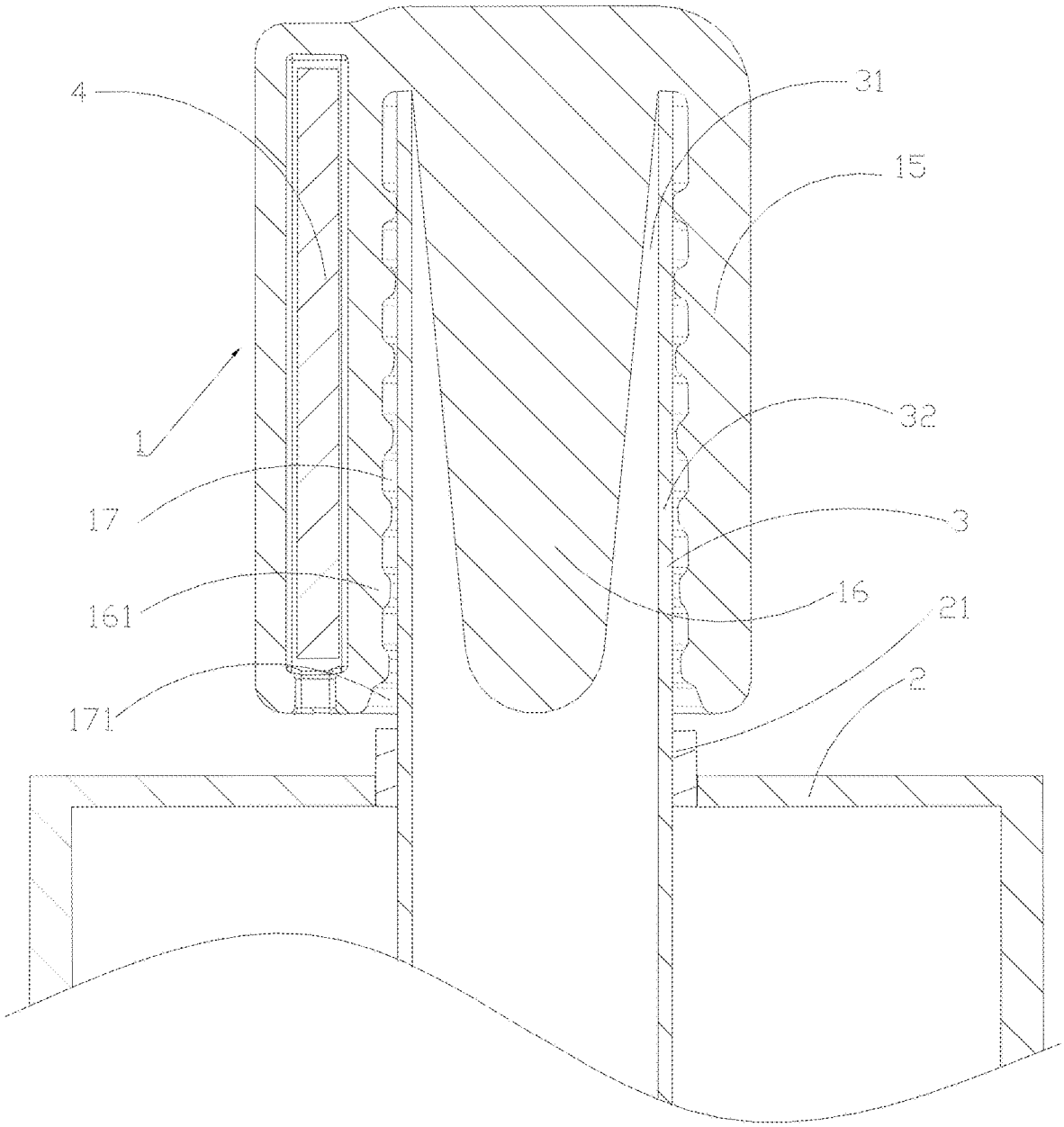
FIG. 8 is a sectional view of a straw main body and a cup main body when the straw main body is inserted into the cup main body through a cup opening, and a sealing lid seals a straw opening.

Referring to FIGS. 6-8, a straw includes: a cup main body 2, the cup main body 2 being equipped with a cup opening 21; a straw main body 3, the straw main body 3 being equipped with a straw opening 31, and the straw main body 3 being inserted into the cup main body 2 through the cup opening 21; a lid main body 1, the lid main body 1 being configured for sealing the straw opening 31; and an attracting element 4, the attracting element 4 being connected to the lid main body 1, and the attracting element 4 being configured for detachably attracting with a side wall of the cup main body 2.

Through the above structure, when the straw is inserted into the cup main body 2 and the lid main body 1 is used to seal the straw opening 31, the lid main body 1 can be magnetically attracted with a side wall of the stainless-steel cup main body 2 through a magnetic attraction element, so that users can use the lid main body 1 to seal the straw opening 31 at any time.

The lid main body 1 includes a top wall 14, a first elastic side wall 15, and an elastic plunger 16. The first elastic side wall 15 and the elastic plunger 16 extend from the top wall 14. A sealing slot 17 is surrounded and formed between the first elastic side wall 15 and the elastic plunger 16. The sealing slot 17 is equipped with a slot opening 171, and the sealing slot 17 is configured for squeezing and sealing the straw opening 31. When a second upper end wall 32 of the straw main body 3 is placed in the sealing slot 17, the lid main body 1 covers the straw opening 31, and an inner wall of the sealing slot 17 squeezes and seals the second upper end wall 32 of the straw main body 3, so that the sealing slot 17 squeezes and seals the straw opening 31.

Figure 9:
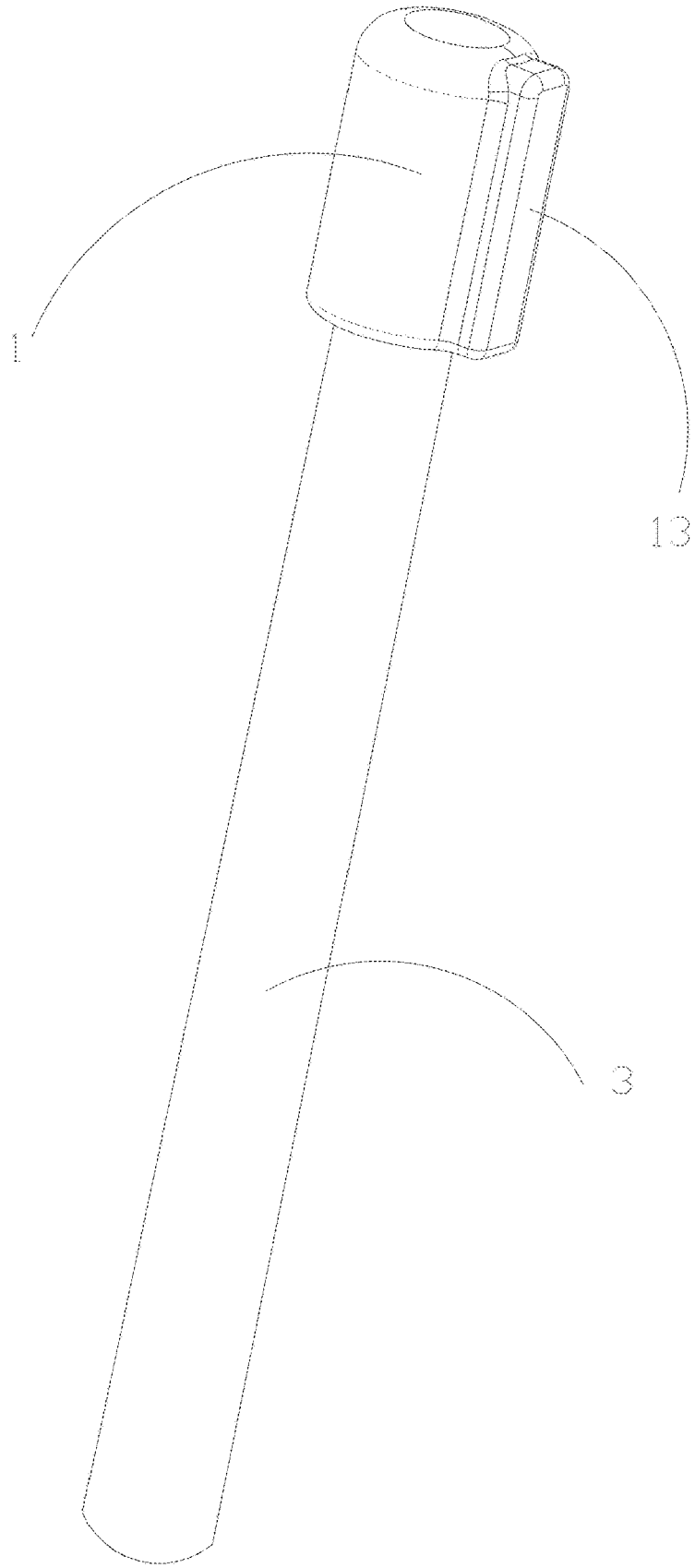
FIG. 9 is a schematic diagram of a structure when a sealing lid seals a straw opening.
Figure 10:
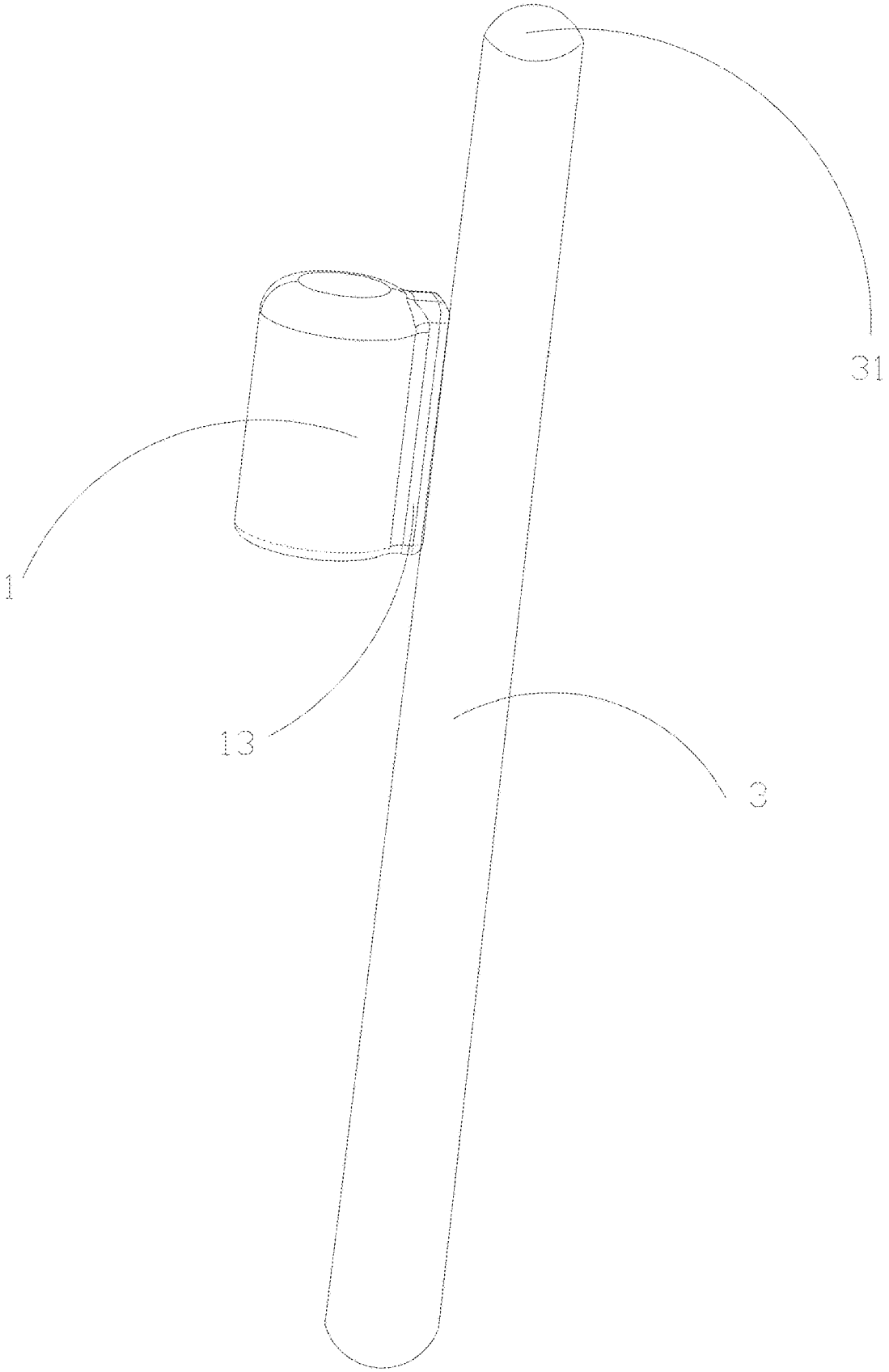
FIG. 10 is a schematic diagram of a structure when a sealing lid attracts with a side wall of a straw main body.
Figure 11:
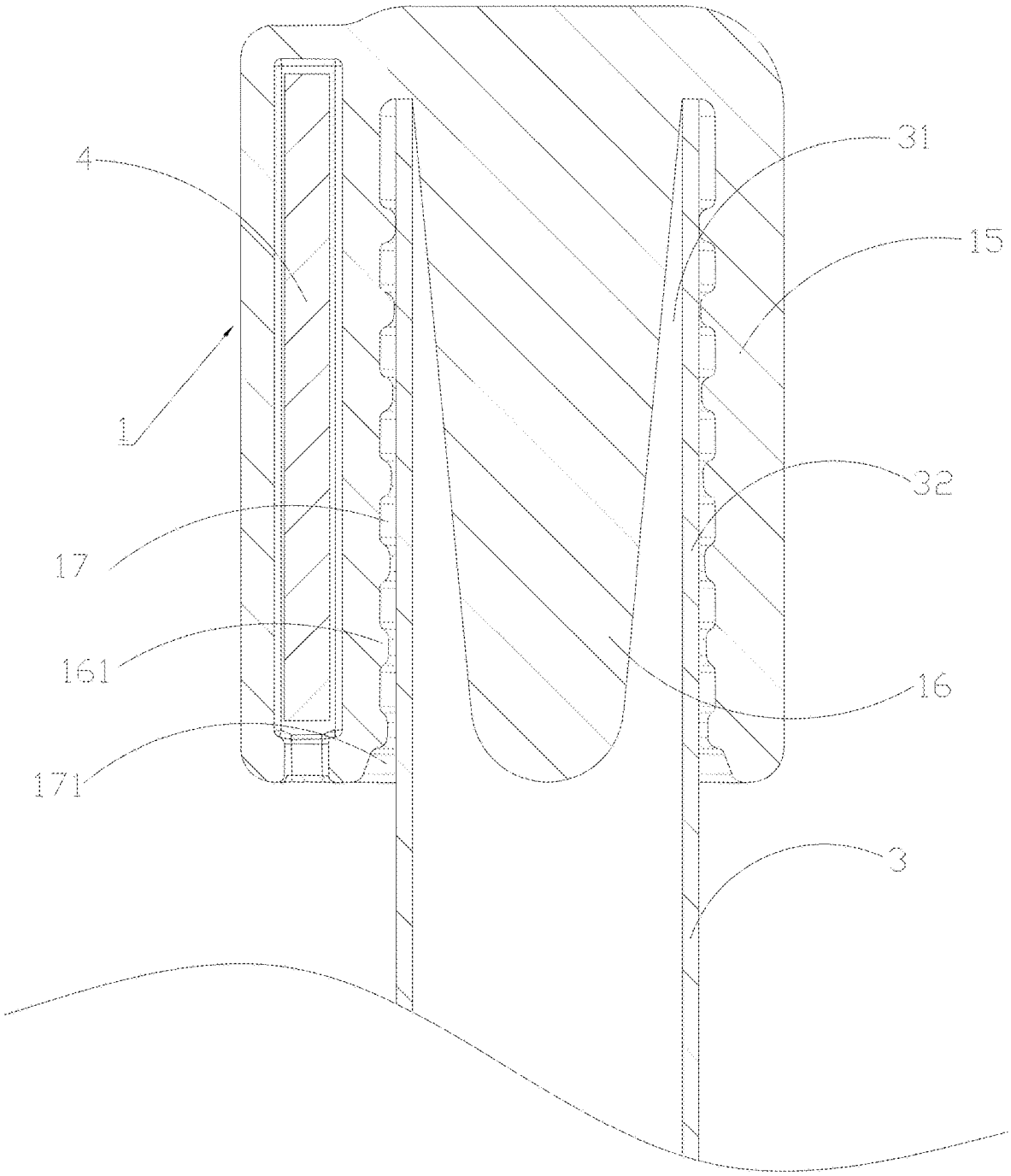
FIG. 11 is a sectional view of a sealing lid and a straw main body when the sealing lid seals a straw opening.

Referring to FIGS. 9-11, a straw includes: a straw main body 3, the straw main body 3 being provided with a straw opening 31; a lid main body 1, the lid main body 1 being configured for sealing the straw opening 31; and an attracting element 4, the attracting element 4 being connected to the lid main body 1, and the attracting element 4 being configured for detachably attracting with a side wall of the straw main body 3.

Through the above structure, when the straw is inserted into the cup main body 2 and the lid main body 1 is used to seal the cup opening 21, the lid main body 1 can be magnetically attracted with a side wall of the stainless-steel straw main body 3 through a magnetic attraction element, so that users can use the lid main body 1 to seal the cup opening 21 at any time.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A sealing lid for a straw, comprising:

a lid main body, the lid main body being configured for sealing a straw opening; and an attracting element, the attracting element being connected to the lid main body, and the attracting element being configured for magnetically attracting with a cup main body or a straw main body, wherein the lid main body is equipped with a first accommodating cavity and a first accommodating opening, the first accommodating cavity is surrounded and formed by a side wall of the lid main body, the first accommodating opening is in communication with the first accommodating cavity, and the attracting element is inserted into the first accommodating cavity through the first accommodating opening; and wherein the lid main body is equipped with a protruding part, and the protruding part extends from a top wall of the lid main body to a bottom wall of the lid main body, the first accommodating cavity is defined in the protruding part, the first accommodating cavity extends from an upper side of the protruding part to a lower side of the protruding part, and the first accommodating opening is defined in a bottom of the protruding part.

2. The sealing lid for the straw of claim 1, wherein the lid main body comprises a first stop part with elasticity, the first accommodating opening is defined in the first stop part, and an inner diameter of the first accommodating opening is expandable and contractible; when the attracting element is placed into the first accommodating cavity through the first accommodating opening, the first stop part keeps the attracting element in the first accommodating cavity.

3. The sealing lid for the straw of claim 2, wherein an initial inner diameter of the first accommodating opening is smaller than an outer diameter of the attracting element, and the inner diameter of the first accommodating opening can be expanded to be greater than or equal to the outer diameter of the attracting element, so that the attracting element is capable of being inserted into the first accommodating cavity through the first accommodating opening; when the attracting element is inserted into the first accommodating cavity through the first accommodating opening, the inner diameter of the first accommodating opening is capable of restoring and contracting to the initial inner diameter, so that the first stop part keeps the attracting element in the first accommodating cavity.

4. The sealing lid for the straw of claim 1, wherein the attracting element is a magnetic attraction element.

5. The sealing lid for the straw of claim 1, wherein the lid main body is flexible, and the lid main body comprises the top wall, a first elastic side wall and an elastic plunger; the first elastic side wall and the elastic plunger extend from the top wall, a sealing slot is surrounded and formed between the first elastic side wall and the elastic plunger, the sealing slot is equipped with a slot opening, and the sealing slot is configured for squeezing and sealing the straw opening.

6. The sealing lid for the straw of claim 5, wherein the first elastic side wall is used for pressing against an outer side wall of the straw opening, the elastic plunger is used for inserting into the straw opening, and the elastic plunger is used for pressing against an inner side wall of the straw opening, so that the sealing slot is used for squeezing and sealing the straw opening.

7. The sealing lid for the straw of claim 5, wherein the first elastic side wall is in a straight cylindrical shape.

8. The sealing lid for the straw of claim 5, wherein the elastic plunger is in a conical shape with a wider top and a narrower bottom, and a diameter of the elastic plunger gradually increases from bottom to top.

9. The sealing lid for the straw of claim 5, wherein the first elastic side wall or the elastic plunger is provided with a plurality of raised elastic sealing parts, the sealing parts are positioned in the sealing slot, and the sealing parts are used for squeezing and sealing the straw opening.

10. The sealing lid for the straw of claim 9, wherein the plurality of sealing parts are uniformly arranged from a lower side of the first elastic side wall to an upper side of the first elastic side wall.

11. The sealing lid for the straw of claim 9, wherein the sealing parts are sealing rings.

12. The sealing lid for the straw of claim 5, further comprising another attracting element arranged in the elastic plunger or the top wall.

13. The sealing lid for the straw of claim 1, wherein the lid main body is made of silicone.

14. The sealing lid for the straw of claim 1, wherein the attracting element and the lid main body are integrally formed by injection molding, or the attracting element is connected to the lid main body by gluing.

15. A cup comprising:

a cup main body, the cup main body being equipped with a cup opening;

a lid main body, the lid main body being configured for sealing the cup opening; and an attracting element, the attracting element being connected to the lid main body, and the attracting element being configured for detachably attracting with a side wall of the cup main body, wherein the lid main body is equipped with a first accommodating cavity and a first accommodating opening, the first accommodating cavity is surrounded and formed by a side wall of the lid main body, the first accommodating opening is in communication with the first accommodating cavity, and the attracting element is inserted into the first accommodating cavity through the first accommodating opening; and wherein the lid main body is equipped with a protruding part, and the protruding part extends from a top wall of the lid main body to a bottom wall of the lid main body, the first accommodating cavity is defined in the protruding part, the first accommodating cavity extends from an upper side of the protruding part to a lower side of the protruding part, and the first accommodating opening is defined in a bottom of the protruding part.

16. He cup of claim 15, wherein the lid main body comprises a top wall, a first elastic side wall, and an elastic plunger; the first elastic side wall and the elastic plunger extend from the top wall, a sealing slot is surrounded and formed between the first elastic side wall and the elastic plunger, the sealing slot is equipped with a slot opening, and the sealing slot is configured for squeezing and sealing the cup opening; when a first upper end wall of the cup main body is placed in the sealing slot, the lid main body covers the cup opening, and an inner wall of the sealing slot squeezes and seals the first upper end wall of the cup main body, so that the sealing slot squeezes and seals the cup opening.

17. The cup of claim 15, wherein the attracting element is a magnetic attraction element.

18. A straw comprising:

a cup main body, the cup main body being equipped with a cup opening;

a straw main body, the straw main body being equipped with a straw opening, and the straw main body being inserted into the cup main body through the cup opening;

a lid main body, the lid main body being configured for sealing the straw opening; and an attracting element, the attracting element being connected to the lid main body, and the attracting element being configured for detachably attracting with a side wall of the cup main body, wherein the lid main body is equipped with a first accommodating cavity and a first accommodating opening, the first accommodating cavity is surrounded and formed by a side wall of the lid main body, the first accommodating opening is in communication with the first accommodating cavity, and the attracting element is inserted into the first accommodating cavity through the first accommodating opening; and wherein the lid main body is equipped with a protruding part, and the protruding part extends from a top wall of the lid main body to a bottom wall of the lid main body, the first accommodating cavity is defined in the protruding part, the first accommodating cavity extends from an upper side of the protruding part to a lower side of the protruding part, and the first accommodating opening is defined in a bottom of the protruding part.

19. The straw of claim 18, wherein the lid main body comprises a top wall, a first elastic side wall, and an elastic plunger; the first elastic side wall and the elastic plunger extend from the top wall, a sealing slot is surrounded and formed between the first elastic side wall and the elastic plunger, the sealing slot is equipped with a slot opening, and the sealing slot is configured for squeezing and sealing the straw opening; when a second upper end wall of the straw main body is placed in the sealing slot, the lid main body covers the straw opening, and an inner wall of the sealing slot squeezes and seals the second upper end wall of the straw main body, so that the sealing slot squeezes and seals the straw opening.

20. The straw of claim 18, wherein the attracting element is a magnetic attraction element.

* * * * *